US005509230A

United States Patent [19]

Miyachi et al.

[11] Patent Number: 5,509,230

[45] Date of Patent: Apr. 23, 1996

[54] LAWN PROTECTING METHOD AND ELASTIC BODY FOR LAWN PROTECTION

[75] Inventors: Yosifumi Miyachi, Jinseki; Kazuto Urakami; Setsuo Taninaka, both of Fukuyama, all of Japan

[73] Assignees: Sanyo Turf Co., Ltd.; Hayakawa Rubber Company Limited, both of Japan

[21] Appl. No.: 306,893

[22] Filed: Sep. 16, 1994

[30] Foreign Application Priority Data

| | | | |
|---|---|---|---|
| Sep. 22, 1993 | [JP] | Japan | 5-269389 |
| Dec. 28, 1993 | [JP] | Japan | 5-337631 |
| Aug. 19, 1994 | [JP] | Japan | 6-195320 |

[51] Int. Cl.[6] ..... A01B 79/00

[52] U.S. Cl. ..... 47/58; 47/1.01

[58] Field of Search ..... 47/1 F, 59, 2, 47/84, DIG. 10, 58.25

[56] References Cited

U.S. PATENT DOCUMENTS

| | | | |
|---|---|---|---|
| 2,632,979 | 3/1953 | Alexander | 47/1 F |
| 3,022,605 | 2/1962 | Reynolds | 47/84 |
| 4,337,283 | 6/1982 | Hass | 428/17 |
| 5,014,462 | 5/1991 | Malmgren | 47/1 F |
| 5,041,320 | 8/1991 | Meredith | 428/17 |
| 5,187,894 | 2/1993 | Ripley | 47/59 |
| 5,326,192 | 7/1994 | Freed | 405/258 |

FOREIGN PATENT DOCUMENTS

| | | | |
|---|---|---|---|
| 286342 | 12/1970 | Austria . | |
| 0322090 | 6/1989 | European Pat. Off. . | |
| 403008 | 12/1990 | European Pat. Off. | 47/1 F |
| 3305894 | 8/1984 | Germany . | |
| 2274997 | 8/1994 | United Kingdom . | |

*Primary Examiner*—Henry E. Raduazo
*Attorney, Agent, or Firm*—Parkhurst, Wendel & Burr

[57] ABSTRACT

The present invention relates to a lawn protecting method for preventing a lawn from being barren by stamping pressure, particularly relates to a lawn protecting method in golf courses, tennis courts, sports stadiums such as soccer fields and an elastic body for lawn protection used therefor. The present invention is a lawn protecting method comprising dispersing fragmental elastic bodies of not less than 0.0003 $cm^3$ and not more than 5 $cm^3$ in volume on a lawn or previously sowed soil, and cultivating turf. Moreover, an elastic body for lawn protection according to the present invention consists of rubber, synthetic resin or their sponge, its cross section is circular, oval, annular, spherical, polygonal and their amorphous shape, and its volume is 0.0003–5 $cm^3$.

5 Claims, 3 Drawing Sheets

LAWN PROTECTING METHOD AND ELASTIC BODY FOR LAWN PROTECTION

BACKGROUND OF THE INVENTION

1. Field of the Invention

The present invention relates to a lawn protecting method for preventing a lawn from the naked ground by stamping pressure, particularly, relates to a lawn protecting method and an elastic body for lawn protection used therefor in golf courses, tennis courts, sports stadiums and the like.

2. Description of the Related Art

The Japanese lawn grass is mainly transplanted and grown in sports stadiums such as golf links, soccer fields and the like, or grounds such as parks and the like, but barren grassy lawns have become a problem caused by damaging grass when there are many players or a game is hard. For preventing a lawn from becoming barren so far, there was a method of installing a porous plastic or rubber mat on a grass lot, growing lawns from pores, and softening a stamping pressure without directly stamping the grass lot, or preventing grass from wearing out by a thickness of the mat.

However, these prior goods have not been used for soccer field, tennis court or golf course because there are many problems such that a player's foot is caught in a mat when he tries to perform sliding in hard sports such as soccer, tennis and the like. Therefore, many grassy lawns used for sports, particularly golf courses, soccer fields and tennis court limit the numbers of players, reduce the number of games or provide suitable recess for growing grass, so that many people had difficulty to sufficiently utilize grassy lawns.

Moreover, in case of striking a ball at the teeing ground of a golf course, a club is caught in a mat and cannot be gotten free.

Furthermore, in care of regrowing a grassy lawn, even if lawn leaves are mowed or worn out, the grassy lawn can regrow as far as lawn buds are healthy, but in case of destroying lawn buds, grass cannot regrow from the same place but germinates from a neighbor node or a node of the straight stem root. In the case of using a grassy lawn for hard sports such as soccer and tennis, even lawn buds are often destroyed, and in this case, it takes considerable time for germination again and it is necessary to keep off the grass for a long period of time in order to grow grass.

Therefore, it is not only necessary to prevent the whole grass from wearing out, but also necessary to improve utilization of a grassy lawn by quickening the regrowing regrowthing time of grass from wearing out, so that any wearing out should be stopped at the leaf portion, and the germinating foot portion should be protected.

SUMMARY OF THE INVENTION

An object of the present invention is to obviate such prior shortcomings, and to provide a grassy lawn where sports can be played safely on lawns such as golf courses, tennis courts, soccer fields, rugby fields, school grounds, parks and like, children can play without stumbling, the grassy lawn is scarcely worn out even if many people utilize it, and the wornout portion is quickly revived.

In order to attain such object, the present inventors have earnestly studied and obtained the present invention. That is, the present invention relates to a lawn protecting method comprising dispersing fragmental elastic bodies of less than 5 $cm^3$ and more than 0.0003 $cm^3$ on a lawn or previously turf sowed soil and cultivating turf.

Another object of the present invention is to provide an elastic body for lawn protection consisting of a lawn protecting elastic body, rubber or synthetic resin or their sponge-like elastic body, its cross section being molded into circular, annular, polygonal, spherical and their amorphous molds, and its volume being 0.0003–5 $cm^3$.

In case of carrying out the present invention, the specific gravity of an elastic body is preferably not less than 0.1 and not more than 3.0. Moreover, the elastic body of the present invention is preferably 3–10 mm in thickness and not more than 3–5 mm in length.

Moreover, one dispersion per 1 $m^2$ for the turf sowed ground surface is preferably within a range of about 0.2 kg–6.0 kg.

In a protecting method of the present invention, when elastic bodies are dispersed on normally mowed turf, the elastic bodies are gradually buried in the ground. Moreover, when elastic bodies are dispersed on short mowed turf or turf sowed soil, the elastic bodies enter into turf leaves and straight stems together with the growth of turf to protect the roots of the straight stems.

Moreover, in a preferred embodiment of the present invention, as an elastic body use may be made of rubber material, synthetic resin material or their sponge-like material having a circular, oval, annular, polygonal or their amorphous and combined shape in cross section, about 3 mm–10 mm in thickness (outer diameter dimension), 3 mm–30 mm in length and 30°–80° in hardness, and this elastic body is dispersed on the turf sowed grounds such as sports stadiums, golf links and the like within a range of about 0.2 kg–6.4 kg per 1 $m^2$ for the purpose of planning to protect and grow turf efficiently.

As an elastic body used for a lawn protecting method of the present invention, use can be made of rubber, thermoplastic elastomer, plastics and the like, and it is preferable to mix pigment therein and color the elastic body. The pigment is preferably black or green which is a lawn quasi color. When the elastic body is black, it is useful for heat insulation and freeze prevention in the winter season, and when the elastic body is quasi green in dark green lawn season, the elastic body can assimilate into a lawn in external appearance, supplement a pale yellow color in recession of a lawn, and act to form a quasi evergreen as a whole.

Moreover, various shapes can be used as far as an elastic body is immovable. A relatively elongated shape is effective because the shape can easily enter into lawn leaves and straight stems and cannot came out under leaves.

The elastic body can increase its flexibility by forming into a solid core structure or hollow tubular structure.

According to the inventors' test, depending on the kind of grassy lawn soil though, the elastic body is preferably 30–80 in hardness (JIS Shore A). When the hardness is outside this range, a sufficient interference effect cannot be obtained against stamping pressure, and when the hardness is too hard, the lawn roots are damaged.

Similarly, the specific gravity is effective within a range of 1.4–3.0, where the elastic body cannot simply float or sink. More preferably, if a spontaneously decomposable high polymer is used as an elastic body, and fertilizer is mixed therein, it is possible to save time for dispersing any fertilizer.

An elastic body according to the present invention can be manufactured by grinding a previously suitably colored rubber material or synthetic resin material or their sponge material into 0.8 mm–5 mm in diameter.

An elastic body can further be manufactured by extruding into a string by means of an extruder and suitably cutting the string. Moreover, an elastic body can be manufactured by minutely pelletizing waste products such as rubber tires, belts and the like.

In case of reclaiming a lawn grass land, such elastic bodies are uniformly dispersed on preferably a lawn mowed as short as possible. The elastic bodies of the present invention are similarly dispersed on previously sowed soil, and uniformly dispersed without tangling each other. According to the present inventors's test, depending the kind of soil and grass though, a ground covering rate of the elastic body to the lawn ground is preferably within a range of 40–80%. After dispersion, usual lawn control is carried out and completed when turf is grown.

The thus formed lawn ground, even if many people walk or play games, can prevent the soil from hardening by stamping pressure because of elasticity of an elastic body, can support much weight added to a grassy lawn when pedestrians walk thereon, can reduce weight directly added to turf, so that the elastic body of the present invention can prevent turf from wearing out, protect turf buds, and accelerate turf regrowth. Moreover, the elastic bodies are independent, respectively, and are not integrated as a porous mat and the like, so that a player is not caught in grass by sliding in sports such as soccer, rugby, baseball and golf ball, and can play any game.

DESCRIPTION OF THE PREFERRED EMBODIMENT

The present invention is concretely explained by referring to examples as follows.

FIG. 1 shows an embodiment of the elastic body used for a method of reclaiming turf according to the present invention.

Figure 1A:
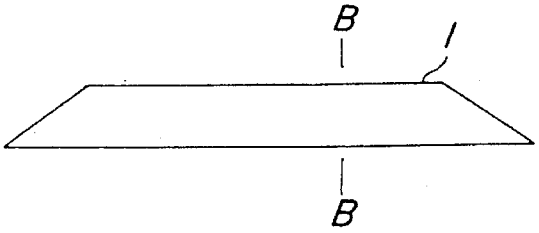
FIGS. 1A and 1B are a front view and a cross-sectional view showing one embodiment of an elastic body according to the present invention.
Figure 1B:
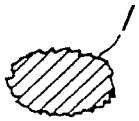

An elastic body 1 of this embodiment is elongated as shown in a front view of FIG. 1(A), and obliquely cut at both end portions. As shown in FIG. 1(B), a cross-sectional shape of the elastic body 1 is oval with stripes around the circumference.

Figure 2:
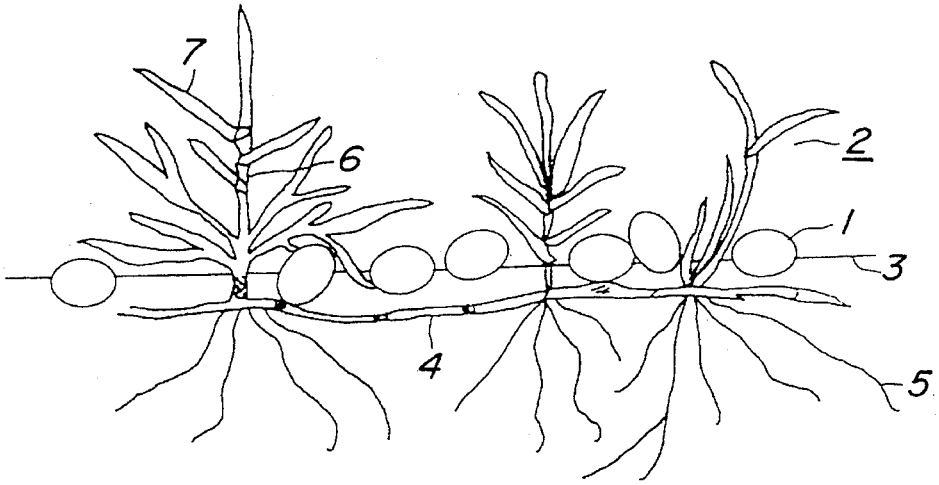
FIG. 2 is a cross section of a grassy lawn applying a lawn protecting method according to the present invention.

FIG. 2 shows a condition of dispersing the elastic body 1 of FIG. 1 on a ground surface 3 grown with a turf 2. Moreover, reference numeral 4 is a Crawling stem, 5 a root, 6 a straight stem and 7 a leaf. The elastic body 1 of the present invention is preferably dispersed within a range of about 2000 g–6000 g per 1 $m^2$.

The present invention aims to protect the root stems and node portions of turf from stamping pressure, and to accelerate the regrowth of turf, and according to the present inventors' test result, when a dispersion amount per 1 $m^2$ is about less than 2000 g, the amount is relatively few, and the above function and effect cannot be remarkable. On the other hand, when a dispersion amount is at least about 6000 g, density becomes too large to shade leaves, or to impede sunbeams reaching to the root stems.

The elastic body dispersed on the turf surface is gradually buried by stamping pressure, but in this case, it is excellent to make the chip end sharpened or unevenly amorphous for becoming acclimated to the ground surface.

Next, according to the embodiment of FIG. 1, an explanation is made on the basis of comparative test results between a lawn where the present lawn protecting method is carried out and a lawn where the present lawn protecting method is not carried out.

Elastic bodies used in the tests are of the same construction shown in FIG. 1, that is, 5 cm in length, 60° in both end cut angle, 1 cm in long side and 0.5 cm in short side of a cross-sectional oval, and 1.5 in specific gravity. A raw material of the elastic body 1 consists essentially of natural rubber, and unvulcanized kneaded rubber including filler, colored pigment, vulcanization accelerator, age resister and the like, is extruded by a rubber extruder, thereafter vulcanized by a usual vulcanization process, and obliquely cut at both ends.

The thus manufactured elastic body is uniformly dispersed on a short-mowed lawn in amount of 3000 g per 1 $m^2$, lightly scattered by means of a rake, oriented in the substantially same direction, and generally cultured for three weeks.

Thereafter, 100 persons walked on a place limited to 1 mm in length and 70 cm in width every day, and 100 persons with soccer spike shoes slid thereon five times every day. These practices were repeated for one month, and as result, the portion where the present invention was carried out became barren about 5%, while the portion where the present invention was not carried out became barren about 50%.

As another comparative example is explained by referring to the teeing ground of a golf course. When there are 200 players a day, if a teeing mark was not changed in a day or two, a stamping pressure proved a hindrance to turf surface protection and growth, but teeing mark position change can be extended 6–8 times.

Next, another example of the elastic body for lawn protection used for the lawn protecting method of the present invention is explained.

Figure 3A:
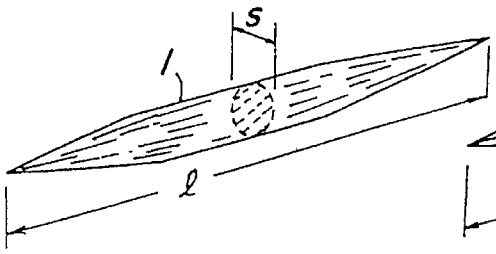
FIGS. 3A, 3B, 3C, 3D, 3E, 3F and 3G are perspective views showing another embodiment of the elastic body of the present invention.
Figure 3B:
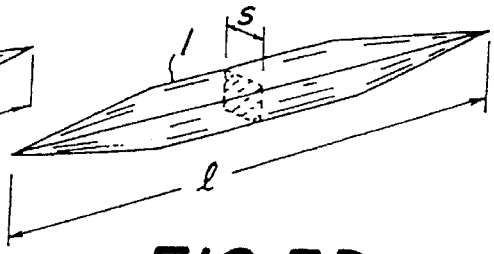

FIGS. 3A–3G show each embodiment of the elastic body 1, in which the elastic body shown in FIG. 3A is a circular rod in cross section sharpened at both ends. The elastic body shown in FIG. 3B is square rod in cross section sharpened at both ends.

Figure 3C:
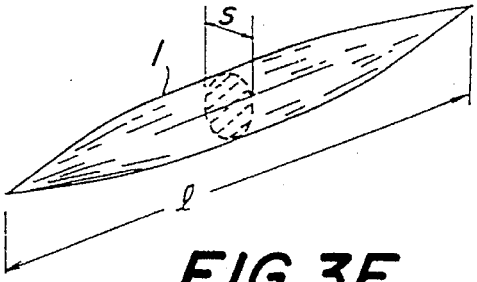
Figure 3D:
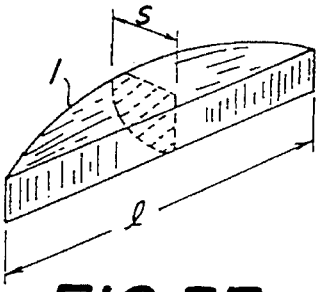

The elastic body shown in FIG. 3C a rod combining a circle and a line in cross section sharpened at both ends. The elastic body shown in FIG. 3D is Japanese comb-shaped combining an arc and a line in cross section.

Figure 3E:
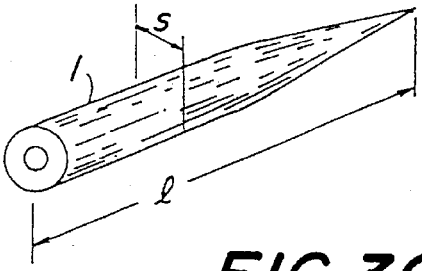
Figure 3F:
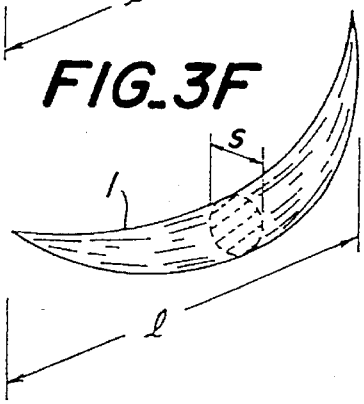
Figure 3G:
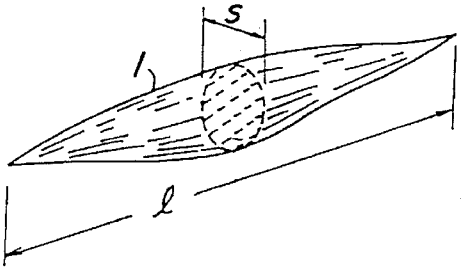
Figure 4A:
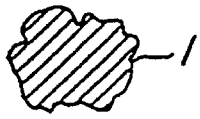
FIG. 4 is a perspective view showing substantially spherical or slightly sharpened chip-like or uneven amorphous shape.
Figure 4B:
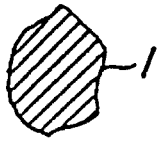
Figure 4C:
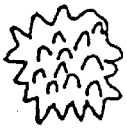
Figure 4D:
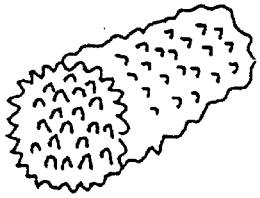
Figure 4E:
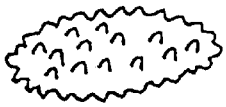
Figure 4F:
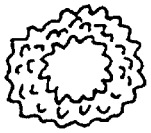

The elastic body shown in FIG. 3E is a tubular rod in cross section sharpened at one end. The elastic body shown in FIG. 3F is egg-shaped in cross section and a crescent rod. The elastic body shown in FIG. 3G is sweet potato-shaped.

The elastic bodies in each embodiment are about 3 mm–10 mm in thickness (outer diameter dimension) s and about 50 mm–80 mm in length.

FIG. 4 shows elastic bodies having substantially spherical or slightly sharpened chip or uneven amorphous shape.

Figure 5A:
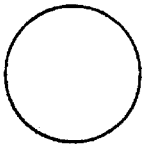
FIG. 5 shows spherical, circular and tubular shapes.
Figure 5B:
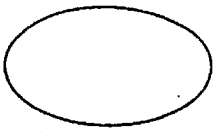
Figure 5C:
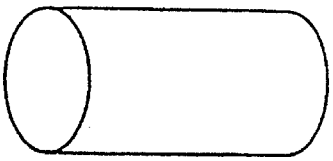

FIG. 5 shows spherical, circular and tubular elastic bodies.

Moreover, a material used is a green mold of natural rubber, synthetic rubber, synthetic resin and the like, and its hardness is within a range of about 30°–80°.

Both the cases of using the embodiments shown in FIGS. 3A–3G and the embodiment shown in FIG. 4 obtained the same effect as that shown in FIG. 1.

As explained above in detail, the lawn protecting method and the elastic body for lawn protection according to the present invention prevent the soil from hardening by stamping pressure, further prevent the turf from wearing out, protect turf buds, and particularly exhibit remarkable effect for protecting the turf surface of sports stadiums such as hard soccer games and the like and the lawn growth. Moreover, the present invention is carried out for protecting the turf surface and turn growth mainly at teeing ground, golf cart path, spectators' path in golf course. Particularly, the present invention obtains great effect by using for heat insulation, moisture resistance and snow melting effects in the winter season. Moreover, no large equipment investment is necessary, and the present invention has a merit of the production with the aid of conventional manufacturing facilities.

What is claimed is:

1. A method for protecting natural grass, particularly the root stem and node portions thereof, from destruction by walking, playing, or sliding thereon, comprising (a) selecting a plot of established natural grass in need of protection and no artificial grass or artificial soil amendment, and (b) dispersing on said plot fragmented elastic bodies having a volume of at least 0.003 $cm^3$ and not more than 5 $cm^3$ at a rate of about 0.2 $kg/m^2$ to about 6 $kg/m^2$ to protect said natural grass from destruction by walking, playing, or sliding thereon.

2. The method of claim 1 wherein said fragmented elastic bodies have a density of not less than 1.0 and not more than 3.0 $g/cm^3$.

3. The method of claim 1 wherein said fragmented elastic bodies have an outer diameter of about 3 to about 10 mm and a length of about 3 to about 30 mm.

4. The method of claim 1 wherein said fragmented elastic bodies have a JIS Shore A hardness of about 30° to about 80°.

5. The method of claim 1 wherein said fragmented elastic bodies have a specific gravity of about 1.4 to about 3.0.

* * * * *

UNITED STATES PATENT AND TRADEMARK OFFICE

CERTIFICATE OF CORRECTION

PATENT NO. : 5,509,230
DATED : April 23, 1996
INVENTOR(S) : Yosifumi Miyachi et al It is certified that error appears in the above-indentified patent and that said Letters Patent is hereby corrected as shown below:

Column 6, In Claim 1, line 4 from the bottom, correct "at least 0.003 $cm^3$" to --at least 0.0003 $cm^3$--.

Signed and Sealed this

Fourth Day of March, 1997

*Attest:*

*Attesting Officer*

BRUCE LEHMAN

*Commissioner of Patents and Trademarks*